US007381226B2

(12) United States Patent
Cooke et al.

(10) Patent No.: US 7,381,226 B2
(45) Date of Patent: Jun. 3, 2008

(54) METHOD OF LAUNDERING COLOURED FABRICS

(75) Inventors: Deborah Jane Cooke, Wirral (GB); Sarah Dixon, Wirral (GB); Timothy David Finch, Wirral (GB); Colette Elizabeth Laurie, Little Sutton (GB); Andrew Philip Parker, Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/535,485

(22) PCT Filed: Nov. 18, 2003

(86) PCT No.: PCT/EP03/12926

§ 371 (c)(1),
(2), (4) Date: May 17, 2005

(87) PCT Pub. No.: WO2004/046295

PCT Pub. Date: Jun. 3, 2004

(65) Prior Publication Data

US 2006/0053565 A1 Mar. 16, 2006

(30) Foreign Application Priority Data

Nov. 21, 2002 (GB) ..... 0227242.5

(51) Int. Cl.
*D06B 13/00* (2006.01)

(52) U.S. Cl. ..... 8/137; 8/115.6; 134/42

(58) Field of Classification Search ..... 8/137, 8/115.6; 510/276; 134/42
See application file for complete search history.

(56) References Cited

U.S. PATENT DOCUMENTS

| | | | | |
|---|---|---|---|---|
| 2,602,781 A | | 7/1952 | Bacon et al. | |
| 4,174,305 A | | 11/1979 | Burns et al. | |
| 4,441,881 A | * | 4/1984 | Ruppert et al. | 8/137 |
| 4,540,499 A | * | 9/1985 | Sakatani et al. | 510/515 |
| 4,780,101 A | | 10/1988 | Watanabe et al. | |
| 5,965,517 A | | 10/1999 | Mooney | |
| 6,200,351 B1 | | 3/2001 | Schleinig et al. | |
| 6,372,901 B1 | * | 4/2002 | Partain et al. | 536/90 |
| 6,833,347 B1 | | 12/2004 | Wang et al. | |

FOREIGN PATENT DOCUMENTS

| | | |
|---|---|---|
| EP | 0 331 237 | 2/1989 |
| EP | 0 467 485 | 7/1991 |
| EP | 0 537 578 | 4/1993 |
| EP | 1 205 116 | 5/2002 |
| GB | 432 404 | 7/1935 |
| GB | 1 537 287 | 4/1975 |
| WO | 98/04772 | 2/1998 |
| WO | 99/14295 | 3/1999 |
| WO | WO 99/61479 | * 12/1999 |
| WO | WO 00/65015 | * 11/2000 |
| WO | 01/51496 | 7/2001 |

OTHER PUBLICATIONS

International Search Report, PCT/EP03/13329, mailed Apr. 8, 2004, 3 pp. GB Search Report, GB 0228358.8, dated May 19, 2003, 1 p. JP 7258968 A (Union Kagaku Kogyo), WPI Abstract Acc. No. 1995-380582, See Abstract.
Parker, U.S. Appl. No. 11/217,781, filed Sep. 1, 2005, Improvements Relating to Fabric Laundering.

* cited by examiner

*Primary Examiner*—Lorna M. Douyon
*Assistant Examiner*—Amina Khan
(74) *Attorney, Agent, or Firm*—Alan A. Bornstein

(57) ABSTRACT

A method of treating coloured fabrics with a luminance (L*) less than 50, preferably black garments, which comprises contacting the fabrics with a wash liquor comprising 0.001-0.1 g/L of a hydroxyl C2-C4 alkyl derivative of a beta 1-4 polysaccharide, which is preferably hydroxyethyl cellulose, and a surfactant.

4 Claims, No Drawings

METHOD OF LAUNDERING COLOURED FABRICS

TECHNICAL FIELD

The present invention relates to improved products and processes for fabric laundering.

BACKGROUND OF THE INVENTION

Most people are aware that washing and wearing clothes is not good for them. Clothes suffer damage due to abrasion in the wash, particularly around seams and hems. On dark cellulosics (such as black jeans, for example) this damage exposes fibrillated regions of the textile which scatter light differently than undamaged regions.

While the damaged regions may have lost relatively small quantities of dye, they are very easy to perceive and produce a strong visual impact. It has been suggested to reduce the incidence of such damage by using lubricating agents in wash liquors. However the skilled worker is faced with a problem when choosing the right lubricant. Prior proposals have included acrylic materials, dextrans, oily and waxy materials.

Hydroxy ethyl cellulose (HEC) is widely commercially available and is well known as a thickener in a range of surfactant-containing products as well as in paints and other coatings. It is generally produced by the treatment of cellulose with ethylene oxide to give materials with a specified degree of substitution. Related materials are known which comprise other short alkyl chain substituents (typically C2-4). Hydroxy-alkyl derivatives of other beta 1-4 linked poly-saccharrides are also known.

In order to bring about viscosity changes HEC is typically present at levels of 1-2% wt on liquor, depending on the molecular weight of the polymer. It is known that bulk viscosity increases in a wash liquor can have beneficial effects on fabrics being laundered, as the increase in viscosity reduces certain fabric-fabric interactions which can cause degradation of the fabrics through such mechanisms as abrasion etc. However, viscosity increases have negative consequences as well. In particular, they can significantly reduce cleaning.

WO 99/14295 discloses compositions and methods for fabric treatment to impart appearance and integrity benefits, which utilise cellulosic based polymers having ether substituents on the hydroxyl groups of the glucose rings. The substituents take the form —OR where R is one of:

a) —H and —C1-4 alkyl (i.e. an unmodified hydroxyl or an alkyl ether,
b) —$(CH2)_y$—CO—OZ (i.e. a carboxyl terminated alkyl ether which can be esterified with another group, or
c) —$[Et.R_20]_n$-$R_H$. In these compositions n is 0-5 and $R_H$ comprises an alkyl chain, so this comprises either a poly-oxyethylene linker to the alkyl chain or simply the alkyl chain connected to the backbone via an ether linkage.

The benefits disclosed in WO 99/14295 are believed to be obtained by the active component, i.e. the ether, associating itself with the fibres of the fabric to reduce or minimise the tendency for the fabric to deteriorate. It is believed that in many cases the association with or 'recognition' of cellulose by another beta 1-4 chemical species involves an interaction between the backbones of the cellulose and the beta 1-4 polymer.

None of the formulations mentioned above with reference to WO 99/14295 comprise a simple hydroxy alkyl derivative of the saccharide backbone. It has been thought that these materials would not associate with cellulose because the hydroxy alkyl groups would interfere with the backbone-backbone interaction that is believed to be necessary for cellulose recognition.

Several other documents relate to the use of hydroxy-ethyl cellulose (HEC) in laundry detergent products and processes. While several of these mention that HEC can bring cleaning benefits none address the issue of lubrication benefits.

U.S. Pat. No. 2,602,781 discloses the use of hydroxy-ethyl cellulose to enhance soil removal by synergy with the surfactant. Levels of HEC taught are between 1 and 63%, (preferably between 5 and 57%) by weight of product and the stain used was a mixture of carbon black and mineral oil. Tests would probably have been performed on white cloth (standard 'Indian Head' muslin) as they concerned removal of soil.

EP 467,485 is concerned with the provision of softness and antistatic benefits. The formulations comprise alkyl cellulose ethers selected from methyl cellulose, hydroxypropyl methyl cellulose and derivatives of hydroxyethyl cellulose wherein the terminal hydrogen of the hydroxyethyl group is replaced with an alkyl chain having 10-24 carbon atoms.

GB 1,537,287 discloses compositions which comprise 0.1% to 3% of a component selected from alkyl cellulose ethers, hydroxy-alkyl cellulose ethers and hydroxy-alkyl alkyl cellulose ethers. Hydroxy ethyl cellulose DS hydroxy ethyl 1.2 is mentioned (see page 7 lines 4ff). Closely related case U.S. Pat. No. 4,174,305 discloses cellulose based soil release polymers and mentions hydroxy-ethyl cellulose (column 6, lines 24ff). Both patents illustrate soil removal with dirty motor oil. Again, this patent contains no examples of the treatment of coloured cloth with HEC.

EP 0 331 237 discloses the use of a hydrophobically modified nonionic cellulose ether in a fabric softening composition. Hydroxy-ethyl cellulose is mentioned in the body of the patent but it is present only as an example of the substrate that is then modified to form the hydrophobically modified cellulose derivative. Preferred are derivatives of methyl, hydroxyethyl or hydroxypropyl cellulose which have been modified with a $C_{10}$ to $C_{24}$ hydrocarbon.

U.S. Pat. No. 6,200,351 B1 discloses the use of a soil release polymer based on a copolyester of a dicarboxylic acid and a diol or polydiol in the surfactant-free, pre-treatment step of an institutional washing process. Hydroxy-ethyl cellulose derivatives are mentioned (see colum5 lines 55ff).

BRIEF DESCRIPTION OF THE INVENTION

We have now determined that relatively low levels of hydroxy alkyl polysaccharides, which are themselves insufficient to give a marked viscosity increase are however, capable of giving benefits in a wash liquor in terms of reduced fabric abrasion and reduced dye pick-up for coloured cloth.

Accordingly, the present invention provides a method of treating coloured fabrics with a luminance (L*) less than 50 which comprises contacting the fabrics with a wash liquor comprising:

a) 0.1-0.001 g/L of a hydroxy C2-C4 alkyl derivative of a beta 1-4 polysaccharide, and,
b) surfactant.

The invention also subsists in the use of a hydroxy C2-C4 alkyl derivative of a beta 1-4 polysaccharide, at a concentration of 0.1-0.005 g/L, in a surfactant containing wash liquor to reduce fabric abrasion.

Luminance (also known as lightness) is the measure of the brightness of a surface on a black-white scale. It is one of the triplet of independent measurements, the other two being chroma (C*, which measures saturation) and hue (H*, which measures chromatic tone), which can be used to characterise any colour by locating it in a 'colour space'. Changes in these three values can be combined to give the well known measure 'delta E' which is often used to determine the change in colour of an article when it is washed.

In this specification the colour space used as a referent is the CIELAB (International Lighting Commission) system, also known as the CIE 1976 colour space. This is an internationally recognized standard. When L* is 0 the surface being considered is black. When L* is 100, the surface is a white standard. Such a white standard is supplied for use with the Datacolor™ Spectraflash SF600+ reflectance spectrometer.

Colours with luminance (L*) less than 50 are also known herein as 'Class 3' colours. Class 3 colours can be further separated into three sub-classes

- high chroma (C*), saturated colours such as bright purple, and intense blue,
- low chroma muted tones such as browns and olives, and,
- those with little or no chroma e.g. black/dark grey (i.e. no or little chroma).

Class 3 colours are very sensitive to fading. Uneven colour changes occur very readily on Class 3 colours because the lightness differences between areas are large and thus particularly amenable to human perception.

Preferably the method of the invention is applied to articles which have low chroma and are most preferably black.

In typical embodiments of the invention the hydroxy C2-C4 alkyl derivative of a beta 1-4 polysaccharide is a cellulose derivative. Cellulose derivatives are widely available. It is believed that among the beta 1-4 polysaccharides cellulose itself shows excellent cellulose self recognition.

Preferably the hydroxy C2-C4 alkyl derivative is a hydroxy ethyl derivative. This material is not only commonly available, but also shows excellent lubrication benefits.

Preferably the degree of substitution (DS) is 1-3, more preferably 1.5-2.25. Most preferably the DS falls in the range 1.5-2.0. Lower DS levels have poor water solubility, which appears to be important for the lubricating effect. Higher levels appear to lead to problems with particulate soil redeposition.

Preferably the molecular weight of the beta 1-4 polysaccharide is 100,000 to 500,000 Dalton, preferably less than 300,000 Dalton. The beta 1-4 polysaccharide is preferably such that viscosity of the material is 300-400 cps at 2% solution (measured on a Brookfield viscometer using ASTM D2364). The solution viscosity under standard conditions is related to the molecular weight of the beta 1-4 polysaccharide, and the preferred materials have nearly Newtonian viscosity profiles between 1 and 10 reciprocal seconds.

Suitable hydroxy C2 alkyl derivatives of cellulose are available in the marketplace from Dow under the trade name "Cellosize" and from Hercules under the trade name "Natrasol".

Preferred dosage levels are such that the in wash concentration of the beta 1-4 polysaccharide is 0.06-0.01 g/L. In typical European was conditions the dosage of a laundry product is 7 g/L in about 8-15 litres of water depending on the-machine and load.

Preferably the level of beta 1-4 polysaccharide is 0.1-3% wt on fully formulated product, more preferably 0.2-0.8% wt. In this specification, all percentages are weight percentages unless otherwise stated. A typical product would contain 0.5% wt of the polysaccharide which would give an in use concentration of around 0.035 g/L.

DETAILED DESCRIPTION OF THE INVENTION

Carriers and Product Form

The compositions of the invention will generally be used in conjunction with a textile compatible carrier.

In the context of the present invention the term "textile compatible carrier" includes a component which can assist in the interaction of the polymer with the textile.

The carrier can also provide benefits in addition to those provided by the first component e.g. softening, cleaning etc.

The carrier may be a detergent-active compound or a textile softener or conditioning compound or other suitable detergent or textile treatment agent. Many of these (for example cationic softeners and anionic and nonionic detergents) fall within the general definition 'surfactant' as used herein. The surfactant may comprise the entire carrier or other, non-surfactant carrier materials may be present.

In a washing process, as part of a conventional textile washing product, such as a detergent composition, the textile-compatible carrier will typically be a detergent-active compound. Whereas, if the textile treatment product is a rinse conditioner, the textile-compatible carrier will be a textile softening and/or conditioning compound. These are described in further detail below.

The polymer is preferably used to treat the textile in the wash cycle of a laundering process.

The composition of the invention may be in the form of a liquid, solid (e.g. powder or tablet), a gel or paste, spray, stick or a foam or mousse. Examples include a soaking product, a rinse treatment (e.g. conditioner or finisher) or a main-wash product.

Liquid compositions may also include an agent which produces a pearlescent appearance, e.g. an organic pearlising compound such as ethylene glycol distearate, or inorganic pearlising pigments such as microfine mica or titanium dioxide ($TiO_2$) coated mica. Liquid compositions may be in the form of emulsions or emulsion precursors thereof.

Detergent Active Compounds

If the composition of the present invention is itself in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch (Interscience Publishers, 1958), or in the 'Surfactant Science' series (Edward Arnold Publishers, 1967 onwards).

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$-$C_{15}$; primary and secondary alkylsulphates, particularly $C_8$-$C_{15}$ primary alkyl sulphates; alkyl ether sulphates; olefin sulphonates; alkyl xylene sulphonates;

dialkyl sulphosuccinates; and fatty acid ester sulphonates. Sodium salts are generally preferred.

Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are independently hydrocarbyl chains of $C_1$-$C_{22}$ length, typically alkyl, hydroxyalkyl or ethoxylated alkyl groups, and X is a solubilising cation (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5-55 wt %, such as 5-50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant (when present) is in the range of from 2 to 25% by weight, more preferably from 5 to 20% by weight.

Amphoteric surfactants may also be used, for example amine oxides or betaines.

Builders

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{-}1.5\ M_2O.Al_2O_3.0.8\text{-}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5-3.5 $SiO_2$ units in the formula above. They can be prepared readily by reaction between sodium silicate and sodium aluminate, as amply described in the literature.

Alternatively, or additionally to the aluminosilicate builders, phosphate builders may be used.

Textile Softening and/or Conditioner Compounds

If the composition of the present invention is in the form of a textile conditioner composition, the textile-compatible carrier will be a textile softening and/or conditioning compound (hereinafter referred to as "textile softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the textile in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic textile softening compounds are substantially water-insoluble quaternary ammonium materials comprising a single alkyl or alkenyl long chain having an average chain length greater than or equal to $C_{20}$. More preferably, softening compounds comprise a polar head group and two alkyl or alkenyl chains having an average chain length greater than or equal to $C_{14}$. Preferably the textile softening compounds have two, long-chain, alkyl or alkenyl chains each having an average chain length greater than or equal to $C_{16}$.

Most preferably at least 50% of the long chain alkyl or alkenyl groups have a chain length of $C_{18}$ or above. It is preferred if the long chain alkyl or alkenyl groups of the textile softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are described in the above referenced "Surface-Active Agents and Detergents" and "Surfactant Science" reference books. Any of the conventional types of such compounds may be used in the compositions of the present invention.

The textile softening compounds are preferably compounds that provide excellent softening, and are characterised by a chain melting $L\beta$ to $L\alpha$ transition temperature greater than 25° C., preferably greater than 35° C., most preferably greater than 45° C. This $L\beta$ to $L\alpha$ transition can be measured by DSC as defined in "Handbook of Lipid Bilayers", D Marsh, CRC Press, Boca Raton, Fla., 1990 (pages 137 and 337).

Substantially water-insoluble textile softening compounds are defined as textile softening compounds having a solubility of less than $1\times10^{-3}$ wt % in demineralised water at 20° C. Preferably the textile softening compounds have a solubility of less than $1\times10^{-4}$ wt %, more preferably less than $1\times10^{-8}$ to $1\times10^{-6}$ wt %.

Especially preferred are cationic textile softening compounds that are water-insoluble quaternary ammonium materials having two $C_{12\text{-}22}$ alkyl or alkenyl groups connected to the molecule via at least one ester link, preferably two ester links. Di(tallowoxyloxyethyl) dimethyl ammonium chloride and/or its hardened tallow analogue are especially preferred of the compounds of this type. Other preferred materials include 1,2-bis(hardened tallowoyloxy)-3-trimethylammonium propane chloride. Their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic textile softeners, as described in GB 2 039 556B (Unilever).

The compositions may comprise a cationic textile softening compound and an oil, for example as disclosed in EP-A-0829531.

The compositions may alternatively or additionally contain nonionic textile softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

Other Components

Compositions according to the invention may comprise soil release polymers such as block copolymers of polyethylene oxide and terephthalate.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, enzymes, optical brightening agents, and opacifiers.

Suitable bleaches include peroxygen bleaches. Inorganic peroxygen bleaching agents, such as perborates and percarbonates are preferably combined with bleach activators. Where inorganic peroxygen bleaching agents are present the nonanoyloxybenzene sulphonate (NOBS) and tetra-acetyl ethylene diamine (TAED) activators are typical and preferred.

Suitable enzymes include proteases, amylases, lipases, cellulases, peroxidases and mixtures thereof.

In addition, compositions may comprise one or more of anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. The lists of optional components are not intended to be exhaustive.

The preferred mode of delivery of the compositions of the invention is in the form of a fabric washing powder. These are typically dosed at around 7 g/litre, into 15-20 litres of wash water. Thus around 0.06 to 0.01 g/litre of the beta 1-4 polysaccharide will be present in the wash liquor.

In order that the invention may be further and better understood it will be described below with reference to the following non-limiting examples.

EXAMPLES

Example 1 Comparative

This example shows protection of new coloured fabrics from fabric abrasion during washing in a Quickwash™ with hydroxy ethyl cellulose (HEC) in a detergent powder composition White woven cotton sheeting printed with a red and black "Manchester United" design was obtained from Abakhan Fabrics, Coast Road, Mostyn, Flintshire, CH8 9DX, UK, and cut into pieces measuring 20×20 cm and each edge overlooked to prevent fraying. This material was chosen because it is particularly sensitive to colour damage when washed.

A Datacolor™ Spectraflash SF600+ reflectance spectrometer was calibrated using white tile and black trap standards prior to measurement of the reflectance over the wavelength range 400-720 nm at specific points on each fabric piece. This was used to measure delta L and delta E, in accordance with the CIELAB method.

The fabrics were then washed in a Quickwash™ apparatus using the following protocol.

| | |
|---|---|
| Apparatus | Raitech ™ Quickwash ™ Plus. |
| Powder | 97 parts by weight of Persilm Original Non-Bio (ex Lever Faberge) as sold in the UK during the summer of 2002 and 3 parts by weight hydroxy ethyl cellulose (for example Cellosize ™ QP100MH, m. wt. 1,400,000). 16 g of this powder were dosed into the water with 4 g of antifoam granules |
| Fabrics | One coloured fabric piece was place in each of the five compartments of the Quickwash ™. |
| Wash Conditions | The Quickwash programme was executed as follows:<br>1. 30 second drain<br>2. Fill with 3 litres of 15° FH water at 40° C.<br>3. Machine paused and powder added<br>4. Programme resumed<br>5. Agitated for 15 minutes at 40° C.<br>6. Drain for 30 seconds<br>7. Fill with 3 litres of 15° FH water at 40° C.<br>8. Agitate for 5 minutes (Rinse) |

-continued

| |
|---|
| 9. Drain for 30 seconds |
| 10. Dry at 4.0 bar for 1 minute |
| 11. Dry at 3.5 bar for 1 minute |
| 12. Dry at 3.0 bar for 2 minutes |
| 13. Cool-down |

These steps were repeated five times with each of a range of hydroxy-ethyl cellulose (HEC) materials (all Cellosize™ ex DOW), and for a control sample of UK Persil™ Non-Bio (ex Lever-Faberge) that did not contain any hydroxy-ethyl cellulose.

After the completion of the five washing and drying cycles the reflectance of each fabric was recorded at the same points using a calibrated Hunterlab™ Reflectance spectrometer and the delta E (total colour change) and delta L (luminance) values recorded.

Table 1 below shows results for these Quickwash assays. It can be seen that in all cases the addition of HEC at relatively low levels reduced the level of-colour fading by reducing the value of delta L.

TABLE 1

| Example | 'Cellosize' Hydroxy Ethyl Cellulose | Delta L |
|---|---|---|
| Control | None | 10.09 |
| 1a | EP09 | 8.78 |
| 1b | QP40 | 8.81 |
| 1c | QP300 | 8.02 |
| 1d | QP4400H | 8.53 |
| 1e | QP10000H | 9.04 |
| 1f | QP15000H | 9.58 |
| 1g | QP30000H | 8.23 |
| 1h | QP52000H | 7.94 |
| 1I | QP100MH | 8.08 |

Example 2 Comparative

This example shows how the inclusion of HEC prevents dye transfer from coloured cloth to a white monitor.

Dye transfer experiments were performed using the 97/3 mix of example 1 in a Tergotometer at a product dosage of 5 g/L, a liquor cloth ratio of 40:1, a temperature of 40 C, using 20 min wash and 2×5 min rinse. 4 white monitors were used together with 4 dyed clothes (each 10 cm square). Three dyes were used: Direct Red 80, Direct Green 26 and Direct Black 22, all unfixed 'Cielab'™ Standard delta E measurements were obtained (as described in Example 1) and are given in table 2 below. It can be seen that lower levels of dye were picked-up in the washes in which HEC was present as compared with the control (Persil™).

White light reflectance difference measurements (delta E) at the specified wavelengths are given in table 3. These show that, in general, significantly less reduction in reflectance was obtained with the compositions of the invention, containing a low level of HEC, than with the control (Persil™).

TABLE 2

| Dye Pickup Example | Red | Green | Black |
|---|---|---|---|
| 3a (Control) | 34.5 | 25.7 | 33.8 |
| 3b (example) | 33.5 | 18.0 | 28.1 |

TABLE 3

| Reflectance Loss Example | Red (540 nm) | Green (620 nm) | Black (610 nm) |
|---|---|---|---|
| 4a (Control) | 50.67 | 53.12 | 62.16 |
| 4b (example) | 51.49 | 40.16 | 55.14 |

Example 3 Comparative

Samples of white woven cotton (10 cm square) were stained with Dolomite clay (a process carried out by the supplier, Equest). The stained fabric was then attached to a larger piece of woven cotton and placed in a front-loading washing machine (Miele Novotronic™ TN450) along with sufficient white woven cotton ballast to make a load weight of 2.5 kg. The load was then washed using 110 g of Persil™ (as described above) containing 3% of hydroxyethyl cellulose with a molecular weight of 200,000 Dalton through a standard 40° C. cotton cycle. The process was repeated twice using new loads but with a hydroxyethyl cellulose derivatives with molecular weights of 470,000 and 1,400,000. The degree of stain removal was judged by measuring the delta E of the stain before and after washing. A higher value indicates more stain has been removed.

TABLE 4

| | No HEC | M. wt. 200,000 | M. wt. 470,000 | M. wt. 1,400,000 |
|---|---|---|---|---|
| ΔΔE | 16.92 | 9.32 | 6.38 | 5.58 |

These results show that HEC is not (in the case of this stain and under these conditions) effective at improving stain removal. Moreover, a higher molecular weight HEC is more prone to causing problems with particulate stains.

Example 4 Comparative

Samples of white woven cotton sheeting (10×10 cm) were stained with Stanley clay (supplied by Equest). The stained fabric was then attached to a larger piece of woven cotton and placed in a front-loading washing machine (Miele Novotronic TN450™) along with sufficient white woven cotton ballast to make a load weight of 2.5 kg. The load was then washed using 110 g of Persil™ containing varying levels of hydroxyethyl cellulose of molecular weight 200,000 through a normal 40° C. cotton cycle. The degree of stain removal was judged by measuring the delta E of the stain before and after washing. A higher value indicates more stain has been removed.

The experiment was then repeated but prior to the stain being applied, the fabric was washed (machine and conditions as above) in Persil™ containing varying levels of hydroxyethyl cellulose of molecular weight 200,000 through a normal 40° C. cotton cycle using 110 g of Persil™ containing the same amount of HEC as the fabric was prewashed in. As before, the difference in delta E was used to evaluate the degree of stain removed.

TABLE 5

| | | | | | |
|---|---|---|---|---|---|
| Pre-treat | Persil only | Persil only | Persil only | Persil only | Persil only |
| Wash | Persil only | Persil + 0.5% HEC | Persil + 1.0% HEC | Persil + 2.0% HEC | Persil + 3.0% HEC |
| ΔΔE | 28.54 | 28.55 | 29.16 | 24.03 | 23.78 |
| Pre-treat | Persil only | Persil + 0.5% HEC | Persil + 1.0% HEC | Persil + 2.0% HEC | Persil + 3.0% HEC |
| Wash | Persil only | Persil + 0.5% HEC | Persil + 1.0% HEC | Persil + 2.0% HEC | Persil + 3.0% HEC |
| ΔΔE | 28.54 | 23.48 | 20.62 | 20.46 | 19.40 |

These results show that at inclusion levels of HEC above 0.5%, particulate stain removal becomes increasingly problematical.

Example 5

The anti-abrasion benefit was determined by washing consumer articles in both European front-loading and Brazilian top-loading washing machines using normal washing powder and powder containing hydroxyethyl cellulose. The procedure used was as follows:

Wash loads

A selection of 100% cotton garments were purchased from Asda™ and Matalan™. To remove and variability in the production of the garment, each was cut in half—one half washed in standard powder and the other half in powder containing hydroxyethyl cellulose. Thus the two halves could be compared after the process was complete.

Garments used: black denim jeans, dark blue shorts, dark blue T-shirt, dark blue rugby shirt, red/blue printed child's pajama top, blue denim waistcoat, brown sleeveless ribbed top. All these garments fall into the definition of 'class three' colours given above.

Each load comprised two halves of each garment type, a total of 14 garment "parts", weighing 2 kg. Three loads were prepared in this manner. Two pieces of printed knitted cotton with a known abrasion profile were also included in each load to act as markers.

'European' Wash Conditions

The wash processes were carried out in CMS computer-controlled washing machines (Miele Novotronic W980). This ensured that each wash cycle was identical (most modern front-loading washing machines vary the quantity of water depending on the nature of the fabrics present in the wash load). To further ensure that no "machine-dependant" results were obtained, three machines were used and the loads cycled through each machine in turn. In this way, and peculiarities in the washing machines was removed. The wash cycle used was as follows:

Fill, 15 litres
Wash, 40° C., 35 minutes
Flood, 10 litres
Drain
Rinse, 21 litres, 2 minutes
Empty
Rinse, 21 litres, 2 minutes
Empty
Rinse, 21 litres, 2 minutes
Empty
$1^{st}$ spin, 60 seconds @ 90 rpm followed by 120 seconds @ 400 rpm
Rinse, 21 litres, 2 minutes
$2^{nd}$ spin, 60 seconds @ 90 rpm followed by 60 seconds @ 400 rpm
$3^{rd}$ spin, 60 seconds @ 90 rpm followed by 60 seconds @ 400 rpm
$4^{th}$ spin, 60 seconds @ 90 rpm followed by 60 seconds @ 400 rpm
followed by 300 seconds @ 1200 rpm
Distribute, 60 seconds @ 90 rpm Three loads were washed ten times using 105 g of Persil Performance™ (a bleach-containing biological washing powder). The other three loads were washed in 104.48 g Persil Performances™ containing 0.52 g of Cellosize™ QP300 (hydroxyethyl cellulose, m. wt. 200,000 ex Dow Chemicals).

After ten washes, the garments were tumble-dried in a Whirlpool™ Super Capacity Dryer for 70 minutes. They were then allowed to acclimate to the laboratory environment for 48 hours before being paneled.

'Brazilian' Wash Conditions

The wash loads were carried out in top-loading Brastemp™ machines. The wash cycle comprised:

Fill, 65 litres water, ambient temperature, 2 minutes
Agitate for 4- 5 minutes
Stationary soak—26.5 minutes
Mainwash—11 minutes
Drain—5 minutes
Spin cycle—2.5 minutes
Fill for rinse—65 litres, ambient temperature, 2 minutes
Rinse, 6 minutes
Drain, drum stationary, 5 minutes
Spin, 7 minutes The control loads were washed ten times using 117 g of Brilhante™ (ex Lever Brasil) washing powder. The test loads were washed ten times using 116.42 g Brilhante™ with 0.58 g Cellosize™ QP300 QP300 (hydroxyethyl cellulose, m. wt. 200,000 ex Dow Chemicals). The loads were then dried and conditioned as above.

After the garments had conditioned, they were assessed by a team of 12 panelists. Each panelist was given a random selection of 14 garments from each test condition and asked to indicate which garment appeared to have been washed the least number of times (i.e. the least worn appearance). The garments were labeled with random 3-digit numbers for identification.

TABLE 6

Panelist scores, European conditions

| Article | Control | HEC |
|---|---|---|
| Black Jeans | 0 | 4 |
| | 0 | 4 |
| | 2 | 2 |
| | 1 | 3 |
| | 1 | 3 |
| | 0 | 4 |
| Total | 4 | 20 |
| Child's Top | 2 | 2 |
| | 2 | 2 |
| | 0 | 4 |
| | 1 | 3 |
| | 2 | 2 |
| | 1 | 3 |
| Total | 8 | 16 |
| Ruby Shirt | 0 | 4 |
| | 2 | 2 |

TABLE 6-continued

Panelist scores, European conditions

| Article | Control | HEC |
|---|---|---|
| | 1 | 3 |
| | 0 | 4 |
| | 0 | 4 |
| | 0 | 4 |
| Total | 3 | 21 |
| Sleveless Top | 1 | 3 |
| | 2 | 2 |
| | 1 | 3 |
| | 1 | 3 |
| | 1 | 3 |
| | 2 | 2 |
| Total | 8 | 16 |
| Waistcoat | 2 | 2 |
| | 2 | 2 |
| | 0 | 4 |
| | 1 | 3 |
| | 2 | 2 |
| | 2 | 3 |
| Total | 8 | 16 |
| T-Shirt | 0 | 4 |
| | 2 | 2 |
| | 2 | 2 |
| | 0 | 4 |
| | 1 | 3 |
| | 1 | 3 |
| Total | 6 | 18 |
| Shorts | 0 | 4 |
| | 3 | 1 |
| | 1 | 3 |
| | 3 | 1 |
| | 1 | 3 |
| | 4 | 0 |
| Total | 12 | 12 |

TABLE 7

Panelist scores, Brazilian Conditions

| Article | Control | HEC |
|---|---|---|
| Black Jeans | 2 | 2 |
| | 2 | 2 |
| | 1 | 3 |
| | 1 | 3 |
| | 1 | 3 |
| | 0 | 4 |
| Total | 7 | 17 |
| Child's Top | 2 | 2 |
| | 1 | 3 |
| | 2 | 2 |
| | 1 | 3 |
| | 1 | 3 |
| | 2 | 2 |
| Total | 9 | 15 |
| Rugby Shirt | 2 | 2 |
| | 2 | 2 |
| | 1 | 3 |
| | 1 | 3 |
| | 1 | 3 |
| | 0 | 4 |
| Total | 7 | 17 |
| Sleveless Top | 0 | 4 |
| | 2 | 2 |
| | 3 | 1 |

TABLE 7-continued

Panelist scores, Brazilian Conditions

| Article | Control | HEC |
|---|---|---|
| | 3 | 1 |
| | 3 | 1 |
| | 1 | 3 |
| Total | 12 | 12 |
| Waistcoat | 0 | 4 |
| | 3 | 1 |
| | 2 | 2 |
| | 1 | 3 |
| | 1 | 3 |
| | 3 | 1 |
| Total | 10 | 14 |
| T-Shirt | 2 | 2 |
| | 0 | 4 |
| | 2 | 2 |
| | 0 | 4 |
| | 3 | 1 |
| | 2 | 2 |
| Total | 9 | 15 |
| Shorts | 4 | 0 |
| | 0 | 4 |
| | 2 | 2 |
| | 3 | 1 |
| | 1 | 3 |
| | 0 | 4 |
| Total | 10 | 14 |

In all cases bar one, the panelists ranked the garments washed in powder containing hydroxyethyl cellulose as appearing less worn that those washed in conventional washing powder. In the remaining case there was, overall, no difference between the two treatments.

Colour measurements (delta E) were taken from the printed cotton fabrics. Lower values indicate less abrasion has taken place and the colours appear closer to new. These are shown in Table 8 below.

TABLE 8

| Example | Cloth Type | Control | Treated |
|---|---|---|---|
| 2a | Low Binder, Woven, Black | 4.79 | 2.37 |
| 2b | Low Binder, Woven, Blue | 3.68 | 1.62 |
| 2c | Low Binder, Woven, Green | 5.61 | 3.10 |
| 2d | Low Binder, Woven, Red | 8.25 | 4.46 |
| 2e | Normal Binder, Woven, Black | 2.13 | 1.14 |
| 2f | Normal Binder, Woven, Blue | 2.03 | 1.14 |
| 2g | Normal Binder, Woven, Green | 3.57 | 2.87 |
| 2h | Normal Binder, Woven, Red | 7.21 | 5.69 |
| 2I | Low Binder, Knitted, Black | 8.95 | 7.10 |
| 2j | Low Binder, Knitted, Blue | 8.53 | 6.74 |
| 2k | Low Binder, Knitted, Green | 9.79 | 8.39 |
| 2l | Low Binder, Knitted, Red | 13.19 | 11.38 |
| 2m | Normal Binder, Knitted, Black | 3.94 | 3.00 |
| 2n | Normal Binder, Knitted, Blue | 2.66 | 1.80 |
| 2o | Normal Binder, Knitted, Green | 3.69 | 2.92 |
| 2p | Normal Binder, Knitted, Red | 8.36 | 7.24 |
| 2q | Red/Black Print (Black stripe) | 11.64 | 10.12 |
| 2r | Red/Black Print (Red Stripe) | 16.48 | 15.22 |

Taken together these results show that HEC is effective at reducing some negative visual effects of washing on coloured garments. These same visual effects do not occur on white garments.

The invention claimed is:

1. A method of treating coloured fabrics with a luminance (L*) less than 50 which comprises contacting the fabrics with a wash liquor comprising:

a) 0.001-0.1 g/L of hydroxy ethyl cellulose having a beta 1-4 polysaccharide backbone, b) surfactant;

c) wherein the molecular weight of the hydroxyl ethyl cellulose is 200,000 to 300,000 Daltons; and d) wherein the hydroxyl ethyl cellulose has a viscosity of 300-400 cps at 2% wt solution in water.

2. A method according to claim 1 wherein the fabrics are black.

3. A method according to claim 1 wherein the degree of substitution of the hydroxy ethyl cellulose (DS) is 1-3.

4. A method according to claim 1 wherein the degree of substitution of the hydroxy ethyl cellulose (DS) is 1.5-2.25.

* * * * *